United States Patent [19]

Verducci

[11] Patent Number: 4,522,215

[45] Date of Patent: Jun. 11, 1985

[54] HAIR COMB WITH DETACHABLE ORNAMENT

[76] Inventor: Henry A. Verducci, 52 Zella St., Providence, R.I. 02908

[21] Appl. No.: 112,076

[22] Filed: Jan. 14, 1980

[51] Int. Cl.[3] ..... A45D 24/00

[52] U.S. Cl. ..... 132/11 R

[58] Field of Search ..... 132/11 R, 101, 106, 132/148, 103

[56] References Cited

U.S. PATENT DOCUMENTS

| | | | |
|---|---|---|---|
| 646,645 | 4/1900 | Kelly et al. | 132/101 |
| 752,261 | 2/1904 | Rice | 132/106 |
| 785,429 | 3/1905 | Metcalf | 132/148 X |
| 788,117 | 4/1905 | Perotti | 132/101 |
| 792,266 | 6/1905 | Hooper | 132/101 |
| 859,098 | 7/1907 | Mintzer | 132/101 |
| 972,552 | 10/1910 | Lewis . | |
| 1,222,281 | 4/1917 | Fulceri | 132/101 |
| 1,983,978 | 12/1934 | Goodman | 132/148 X |
| 2,510,554 | 6/1950 | Christie | 132/101 |
| 2,814,302 | 11/1957 | Goodwin | 132/103 |
| 3,167,799 | 2/1965 | McKinley . | |

*Primary Examiner*—Gregory E. McNeill

*Attorney, Agent, or Firm*—Salter & Michaelson

[57] ABSTRACT

A hair comb with at least one and preferably a set of several detachable ornaments such that varying ornaments will present a different style, texture or color to the overall comb construction. In this way, a single basic comb can be adapted to various clothing styles and purpose by varying the ornamentation thereof. The ornament includes a body adapted for face to face disposition with the comb back and which is securely but temporarily attached thereto. In a preferred form of the invention, a pair of pins which rearwardly extend from the body of such ornament are adapted to extend into pockets formed between adjacent pairs of comb teeth and the comb body.

4 Claims, 11 Drawing Figures

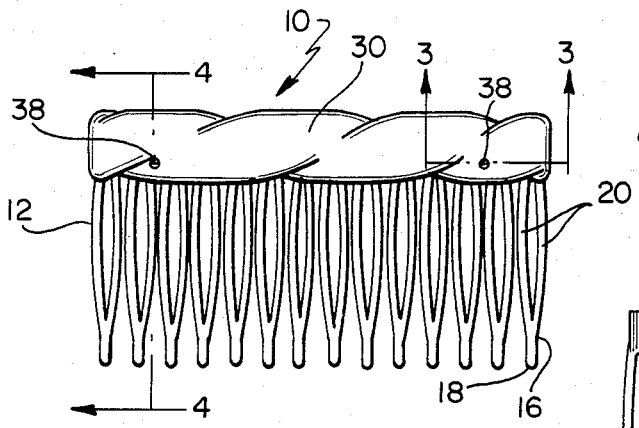
FIG. 1
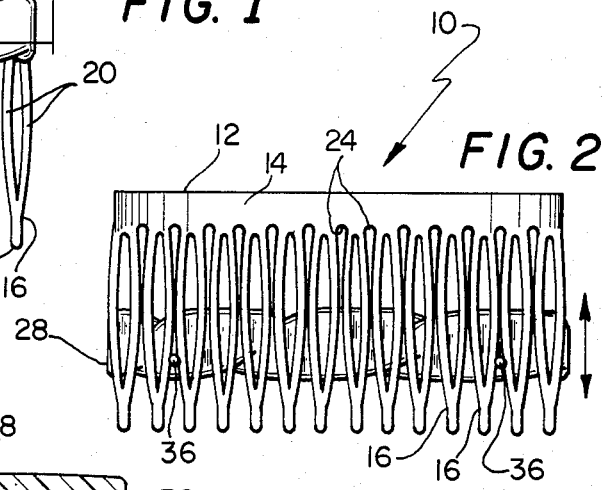
FIG. 2
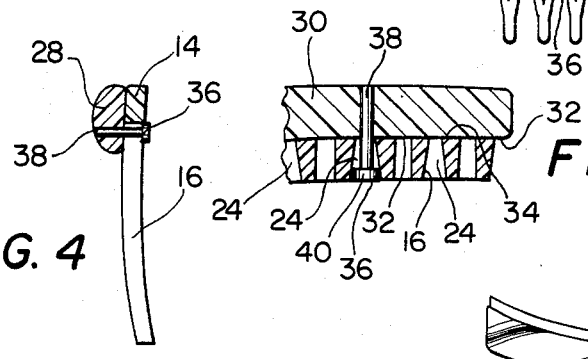
FIG. 4
FIG. 3
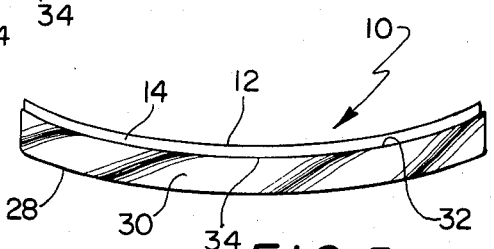
FIG. 5
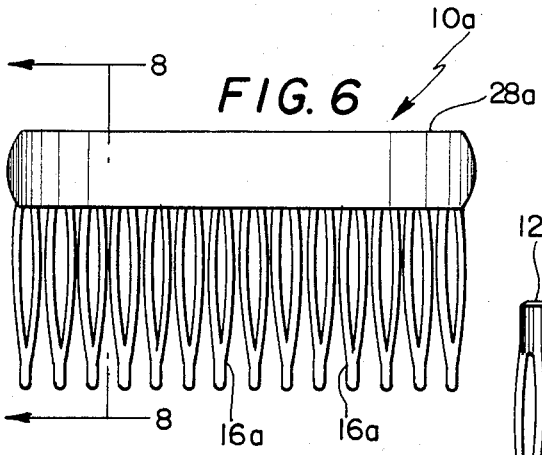
FIG. 6
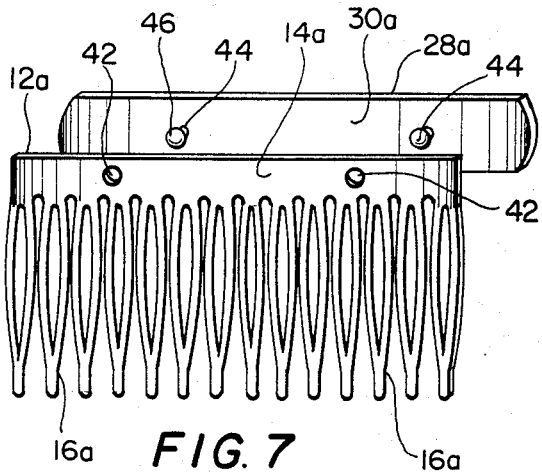
FIG. 7
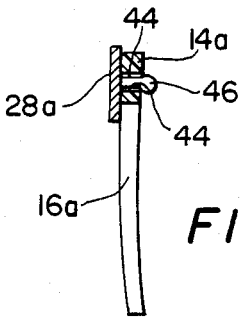
FIG. 8

HAIR COMB WITH DETACHABLE ORNAMENT

BACKGROUND AND SUMMARY OF THE INVENTION

This invention relates to comb construction and more particularly to combs adapted for attachment in the hair of a human, both for holding the hair in place and to serve as an ornamental feature. In this regard, it is often desirable to coordinate the color, style or other appearance of such comb with the wearer's dress mode. For instance, a multi-colored tortoise shell type comb, while suitable for quiet activity and certain sports events might not be desired accessory for disco dancing or other exhibitionist type social contact. In the past, it has accordingly been necessary to purchase a variety of such combs in different styles and colors to fit the social occasion. It would thus be desirable to eliminate the necessity of multiple comb purchases and yet still achieve the desirable multiple style effects achieved by such plurality of combs.

Accordingly, the principal object of the present invention is the provision of a comb structure including a detachable ornament portion such that various ornaments differing as to style and color may be used in conjunction with the comb so as to vary its overall style and color and yet not necessitate the purchase of multiple combs in such particular style and colors.

These and other objects of the invention are accomplished by a hair comb adapted for varying decorative modes comprising a comb having a longitudinally extending comb back from which a plurality of spaced resilient teeth extend in a generally aligned row thereof, a detachable ornament including a longitudinally extending body adapted for generally overlying face to face positioning relative to said comb back, said ornament further including means for temporarily engaging portions of said comb for positioning said ornament with respect to said comb back.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 1 is a front elevational view of a preferred form of a comb constructed in accordance with the present invention;

FIG. 2 is a rear elevational view thereof showing the ornamental portion of the comb partially removed from its normal position;

FIG. 3 is a sectional view taken along the line 3—3 of FIG. 1 and which has been rotated 180°;

FIG. 4 is a sectional view taken along line 4—4 of FIG. 1;

FIG. 5 is a top plan view of the comb construction shown in FIG. 1;

FIG. 6 is a front elevational view showing a modified form of a comb also constructed in accordance with the present invention;

FIG. 7 is a rear elevational view of the comb construction shown in FIG. 6 with the ornamental portion thereof removed;

FIG. 8 is a sectional view taken along line 8—8 of FIG. 6;

DESCRIPTION OF THE INVENTION

Figure 9:
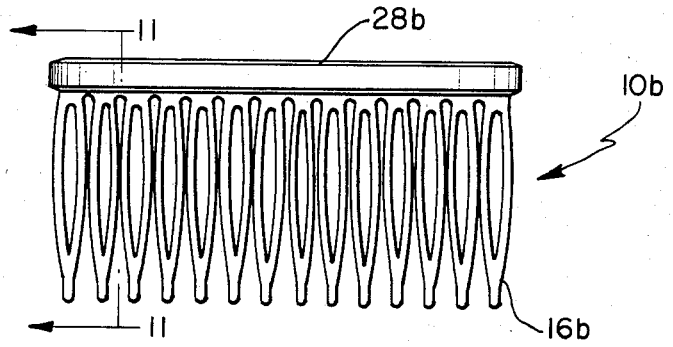
FIG. 9 is a front elevational view showing another modified form of the comb also constructed in accordance with the present invention.

Referring to the drawings and in particular FIGS. 1 through 5 thereof, a comb device 10 is depicted. Such device 10 includes a comb element 12 including a longitudinally orientated comb back 14 from which a plurality of teeth 16 downwardly project. Such teeth terminate in a lower, generally pointed end 18 and are illustrated of a split configuration, that is, each tooth 16 includes spaced opposed runs 20 and 22 which may be resiliently forced together as by displacement of hair therebetween. Although such split tooth construction is shown, the present invention has equal applicability to other known tooth constructions. In any event, the teeth 16 are normally molded as an integral part of the comb back 14 and in this regard adjacent pairs of teeth 16 and the adjacent root portion of the comb back 14 form longitudinally spaced rounded pockets 24 also of somewhat trapezoidal cross-sectional configuration as particularly shown in FIG. 3.

An ornament 28 having a longitudinally oriented body portion 30 is adapted for detachable attachment to the comb 12 such that various ornaments 28 representing different styles, colors and the like may be substituted for each other such that the resultant overall comb device 10 may be coordinated with the dress style and activity of the wearer so as to accomplish the objects of the present invention. In this regard, the ornament body 30 includes a rear surface 32 adapted for face to face engagement with the front surface 34 of the comb back 14. Both the comb back and the ornament may be suitably curved to better follow the contour of the human head if desired. At least two longitudinally spaced pins 36 are adapted to rearwardly extend from the rear surface 32 of the ornament body. Such pins 36 include a generally cylindrical shaft portion 38 and an enlarged head portion 40. Generally the pins 36 are formed of a suitable metal with the forward part of the shaft 38 thereof projecting into the body 30 of the ornament 28 thus forming an attachment therewith. The pins including the headed portions 40 thereof thus rearwardly extend from the body 30 generally at right angles thereto.

As best seen in the transition between FIG. 2 and FIGS. 3 and 4, the pins 36 are adapted to extend between adjacent pairs of teeth 16; entrance therebetween generally being initiated at the outer points or extremities thereof. Thereafter, as the ornament 28 and the comb 12 are moved vertically relative to each other, the pins 36 progress upwardly between such pairs of teeth 16 until they become lodged in the pockets 24. Generally, the extent of such pockets 24 is such to accommodate the largest dimension of the pins 36 including the head portions 40 thereof and accordingly such pockets 24 are normally of a slightly greater extent than the closest spacing between adjacent pairs of teeth 16. In this way then, as the pins move upwardly relative to the comb 12, they resiliently engage the side surfaces of the opposed tooth pairs so as to outwardly deflect such prior to entrance of the pins into the pockets 24. When it is desired to change the ornamentation of the comb device 10, the device is simply removed from one's hair and the ornament 28 frictionally removed therefrom by reversing the above procedure and a different ornament to suit the purpose engaged with the comb 12.

Turning now to FIGS. 6 through 8 of the drawing, an alternate construction of the comb device of the present invention as illustrated. Therein a comb device 10*a* is shown as including a comb 12*a* similar in construction to the previous comb embodiment illustrated in FIGS. 1–5. The comb 12*a* includes a back 14*a* and a plurality of teeth 16*a*. The comb 14*a* is however provided with a pair of spaced openings 42 extending entirely through the thickness thereof.

An ornament 28*a* including a longitudinally orientated body 30*a* is adapted for face to face disposition with regard to the comb 12*a*. In order to removably position the ornament 28*a* to the comb 12*a*, a pair of rearwardly extending pins 44 are provided. The spacing of the pins 44 is such that they are aligned with the openings 42. Additionally, each of the pins 44 is provided with an enlarged rounded terminal element 46 of a maximum dimension slightly greater than that of the openings 42. Generally, the comb 12*a* is formed of a resilient plastic resin material such that an inherent amount of give is present such that the slightly larger elements 46 may be frictionally forced through the openings 42 and held in secure but releasable engagement therewith. In such embodiment when it is desired to remove the ornament 28*a* for replacement with a different ornament, the body 30*a* thereof is simply forced outwardly with respect to the comb back 14*a* so as to separate these parts.

Figure 10:
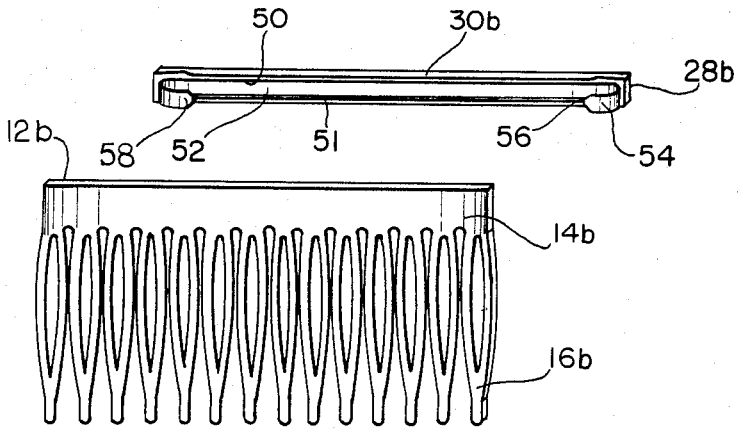
FIG. 10 is a rear elevational view of the comb construction shown in FIG. 9 with the ornamental portion thereof removed.
Figure 11:
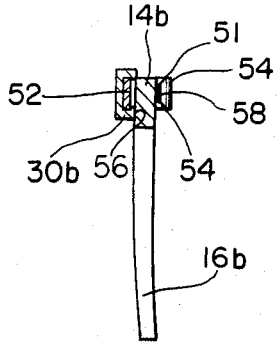
FIG. 11 is a sectional view taken along the line 11—11 of FIG. 9.

Turning now to FIGS. 9 through 11 of the drawing, an alternate construction of the comb device of the present invention is illustrated. Therein a comb device 10*b* is shown as including a comb 12*b* similar in construction to the previous comb embodiments illustrated in FIGS. 1–8. The comb 12*b* includes a back 14*b* and a plurality of teeth 16*b*.

An ornament 28*b* including a longitudinally orientated body 30*b* is adapted for face to face disposition with regard to the comb 12*b*. In order to removably position the ornament 28*b* to the comb 12*b*, a longitudinally oriented, inwardly directed recess 50 is formed in the rear face of the ornament body 30*b*. Enagaging means in the form of a metal blade 51 having a body 52 and terminating in a pair of generally U-shaped spring clips 54 is adapted to be received in the recess 50. In this regard recess 50 is slightly undercut by rounded ledges 56 to better engage the blade which may be slid or snap engaged into the recess 50. The clips 54 each terminate in a narrowed terminal portion 58 which is adapted to engage back portions of the comb in essentially line contact. Also, inasmuch as the blade 51 is preferably formed of a spring type metal, the clips 54 are adapted to resiliently engage the comb.

In such embodiment when it is desired to remove the ornament 28*b* for replacement with a different ornament, the body 30*b* thereof and the comb back 14*b* are simply moved vertically apart from one another, thus separating these parts. Although the ornament 28*b* is shown as of a slightly different configuration than the ornaments 28 and 28*a* shown in the embodiments depicted in FIGS. 1 through 8, it should be brought out that all the ornaments may be of the same or different ornamental configuration, such forming no part of the present invention except to the extent that it cooperates with the comb element 12, 12*a* and 12*b* so as to accomplish the objects of the present invention.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A hair comb device, comprising a longitudinally extending comb back, a plurality of spaced resilient teeth joined at an end thereof to said back in an aligned row, the other ends of said aligned teeth being free for insertion into the hair of the user, a pocket between each pair of adjacent teeth adjacent to the junction of the teeth with said comb back, a longitudinally extending ornament removably mounted in overlying relation on said comb back and including at least a pair of pins extending rearwardly therefrom, said pins being slidably receivable between adjacent teeth for movement into snap-seating engagement in the pockets located between said adjacent teeth for removably mounting said ornament on said comb back in overlying and ornamental relation.

2. A hair comb device as claimed in claim 1, each of said teeth having side surfaces that are spaced from the side surface of an adjacent tooth to a lesser extent at the intermediate portions thereof than at the outer ends and at the ends joined to said comb back, wherein the intermediate portions cooperate to prevent said pins from becoming dislodged from said pockets.

3. A hair comb device as claimed in claim 2, said teeth being compressible at least at their intermediate portions thereby facilitating movement of said pins between the intermediate portions of adjacent teeth to gain entry to the pocket located between said adjacent teeth.

4. A hair comb device as claimed in claim 1, said rearwardly extending pins having enlarged terminal portions.

* * * * *